US011574768B2

(12) United States Patent
Lee et al.

(10) Patent No.: US 11,574,768 B2
(45) Date of Patent: Feb. 7, 2023

(54) COIL COMPONENT

(71) Applicant: SAMSUNG ELECTRO-MECHANICS CO., LTD., Suwon-si (KR)

(72) Inventors: Dong Seob Lee, Suwon-si (KR); Jong Min Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 637 days.

(21) Appl. No.: 16/671,043

(22) Filed: Oct. 31, 2019

(65) Prior Publication Data

US 2020/0194167 A1 Jun. 18, 2020

(30) Foreign Application Priority Data

Dec. 17, 2018 (KR) ..... 10-2018-0162903

(51) Int. Cl.
*H01F 27/32* (2006.01)
*H01F 3/08* (2006.01)
(Continued)

(52) U.S. Cl.
CPC ..... *H01F 27/324* (2013.01); *H01F 3/08* (2013.01); *H01F 17/04* (2013.01); *H01F 27/292* (2013.01);
(Continued)

(58) Field of Classification Search
CPC . H01F 27/34; H01F 3/08; H01F 17/04; H01F 27/292; H01F 27/306; H01F 2017/048
See application file for complete search history.

(56) References Cited

U.S. PATENT DOCUMENTS

2013/0162382 A1* 6/2013 Cha ..... H01F 41/041 336/83
2013/0222101 A1* 8/2013 Ito ..... H01F 3/08 336/83
(Continued)

FOREIGN PATENT DOCUMENTS

CN 104143404 A 11/2014
CN 106531400 A 3/2017
(Continued)

OTHER PUBLICATIONS

Chinese Office Action dated Jun. 3, 2021 issued in Chinese Patent Application No. 201911279532.2 (with English translation).
(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil component includes a body having one surface and the other surface facing each other; an insulating substrate embedded in the body, and having one surface substantially perpendicular to the one surface of the body; a coil portion disposed on the one surface of the insulating substrate, and including a coil pattern layer having a coil pattern and a lead-out pattern extending from the coil pattern and exposed from the one surface of the body; an insulating layer disposed on the one surface of the insulating substrate to cover the coil pattern layer; and first and second external electrodes arranged to be spaced apart from each other on the one surface of the body and respectively connected to the lead-out pattern. A thickness of the lead-out pattern is greater than a thickness of the coil pattern, and less than a thickness of the insulating layer.

18 Claims, 6 Drawing Sheets

(51) Int. Cl.

| | |
|---|---|
| ***H01F 17/04*** | (2006.01) |
| ***H01F 27/29*** | (2006.01) |
| ***H01F 27/30*** | (2006.01) |
| *H01F 41/04* | (2006.01) |

(52) U.S. Cl.
CPC ..... *H01F 27/306* (2013.01); *H01F 41/04* (2013.01); *H01F 2017/048* (2013.01)

(56) References Cited

U.S. PATENT DOCUMENTS

| | | | | |
|---|---|---|---|---|
| 2014/0253277 | A1* | 9/2014 | Takezawa | H01F 27/2804 336/200 |
| 2014/0333405 | A1 | 11/2014 | Choto et al. | |
| 2015/0102891 | A1* | 4/2015 | Yoon | H01F 27/2804 336/200 |
| 2016/0217917 | A1* | 7/2016 | Jeong | H01F 27/292 |
| 2017/0032885 | A1* | 2/2017 | Lee | H01F 41/046 |
| 2017/0110236 | A1* | 4/2017 | Jang | H01F 41/10 |

FOREIGN PATENT DOCUMENTS

| | | | | |
|---|---|---|---|---|
| KR | 10-2013-0049207 | A | | 5/2013 |
| KR | 10-1434351 | B1 | | 8/2014 |
| KR | 10-2016-0057785 | A | | 5/2016 |
| KR | 20160057785 | A | * | 5/2016 |
| KR | 10-2017-0032056 | A | | 3/2017 |
| KR | 10-2017-0097445 | A | | 8/2017 |
| KR | 10-2018-0071644 | A | | 6/2018 |

OTHER PUBLICATIONS

Korean Office Action dated Sep. 17, 2020 issued in Korean Patent Application No. 10-2020-0090648 (with English translation).

* cited by examiner

III-III'

IV-IV'

V-V'

COIL COMPONENT

CROSS-REFERENCE TO RELATED APPLICATION(S)

This application claims benefit of priority to Korean Patent Application No. 10-2018-0162903 filed on Dec. 17, 2018 in the Korean Intellectual Property Office, the disclosure of which is incorporated herein by reference in its entirety.

TECHNICAL FIELD

The present disclosure relates to a coil component.

BACKGROUND

An inductor, a coil component, is a typical passive electronic component used in electronic devices, along with a resistor and a capacitor.

With higher performance and smaller sizes gradually implemented in electronic devices, coil components are becoming thinner.

Here, as coil components become thinner, a bonding area between the end portion of the coil portion and the external electrode gradually decreases, and reliability of bonding between them may become a problem.

SUMMARY

An aspect of the present disclosure is to provide a coil component capable of improving reliability of bonding between a lead-out pattern of a coil pattern layer and an external electrode while being low profile.

According to an aspect of the present disclosure, a coil component includes a body having one surface and the other surface facing each other; an insulating substrate embedded in the body, and having one surface substantially perpendicular to the one surface of the body; a coil portion disposed on the one surface of the insulating substrate, and including a coil pattern layer having a coil pattern and a lead-out pattern extending from the coil pattern and exposed from the one surface of the body; an insulating layer disposed on the one surface of the insulating substrate to cover the coil pattern layer; and first and second external electrodes arranged to be spaced apart from each other on the one surface of the body and respectively connected to the lead-out pattern, wherein each of the coil pattern, the lead-out pattern, and the insulating layer has one surface contacting the one surface of the insulating substrate and the other surface opposing the one surface thereof. A distance (B) from the one surface of the lead-out pattern to the other surface of the lead-out pattern is longer than a distance (A) from the one surface of the coil pattern to the other surface of the coil pattern, and shorter than a distance (C) from the one surface of the insulating layer to the other surface of the insulating layer.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
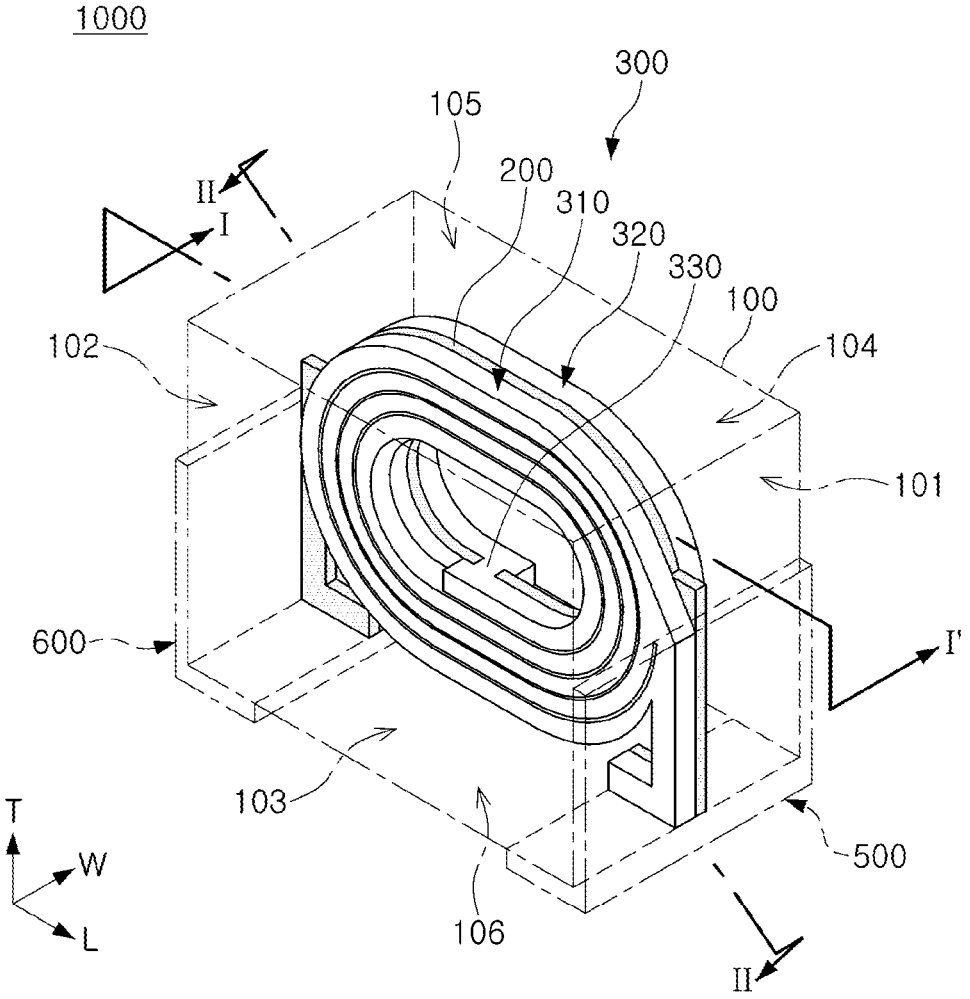
FIG. 1 is a schematic view illustrating a coil component according to a first embodiment of the present disclosure.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, an L direction is a first direction or a length (longitudinal) direction, a W direction is a second direction or a width direction, a T direction is a third direction or a thickness direction.

Hereinafter, a coil component according to an embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

First Embodiment

FIG. 1 is a schematic view illustrating a coil component according to a first embodiment of the present disclosure.

Figure 2:
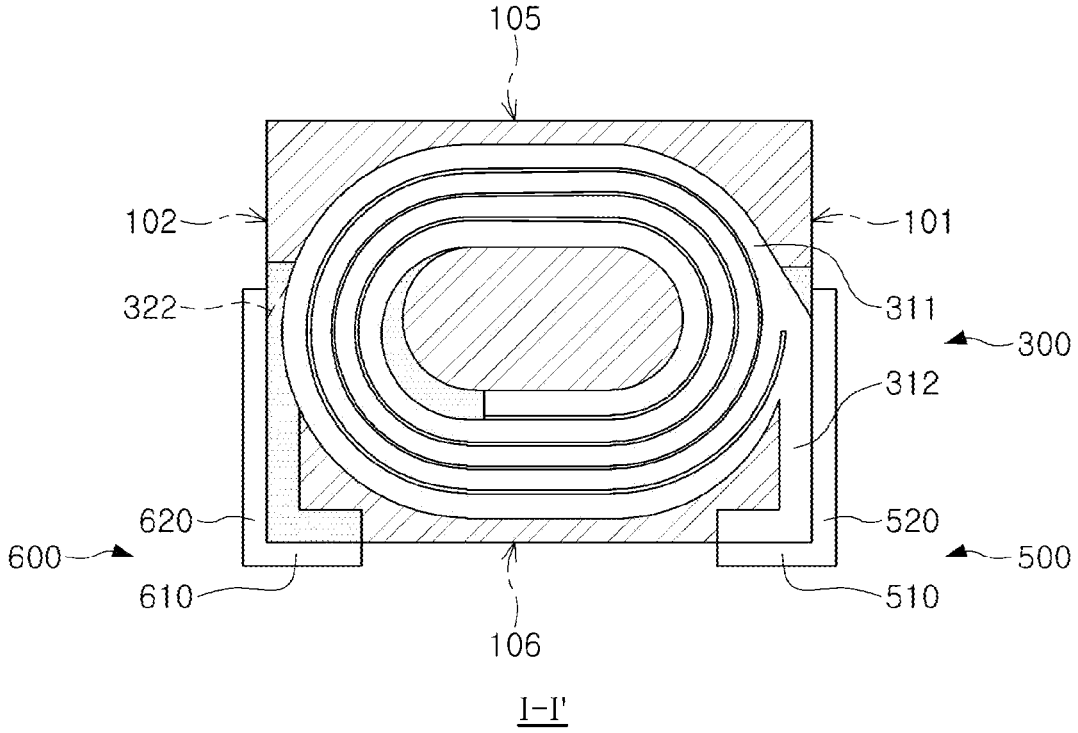
FIG. 2 is a cross-sectional view taken along line I-I' of FIG. 1.
Figure 3:
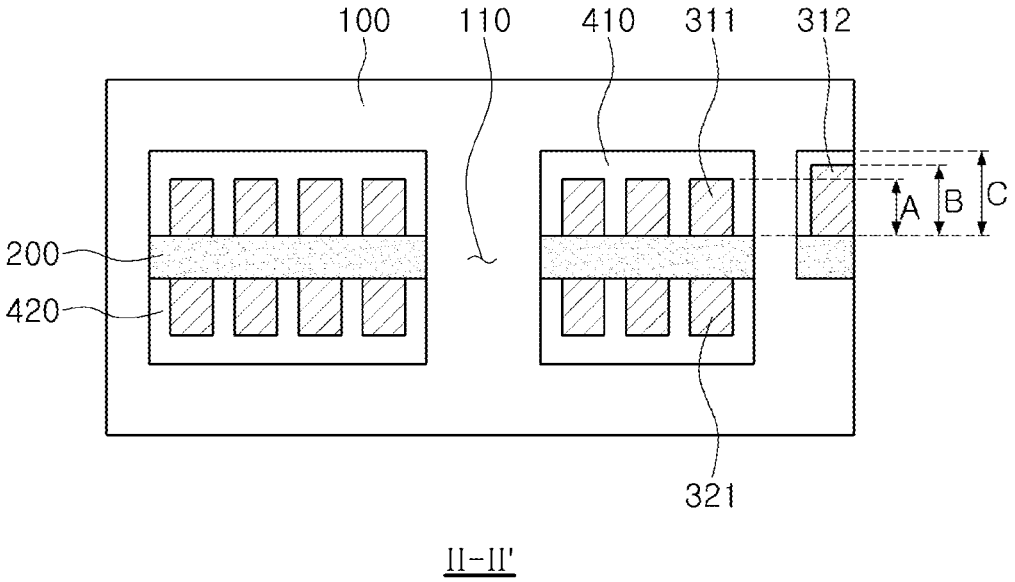
FIG. 3 is a cross-sectional view taken along line II-II' of FIG. 1.

FIG. 2 is a cross-sectional view taken along line I-I' of FIG. 1. FIG. 3 is a cross-sectional view taken along line II-II' of FIG. 1.

Referring to FIGS. 1 to 3, a coil component 1000 according to an embodiment of the present disclosure may include a body 100, an insulating substrate 200, a coil portion 300, insulating layers 410 and 420, and external electrodes 500 and 600.

The body 100 may form an exterior of the coil component 1000 according to this embodiment, and the insulating substrate 200 and the coil portion 300 may be embedded therein.

The body 100 may be formed to have a hexahedral shape overall.

Referring to FIGS. 1 to 3, the body 100 may include a first surface 101 and a second surface 102 facing each other in a length direction L, a third surface 103 and a fourth surface 104 facing each other in a width direction W, and a fifth surface 105 and a sixth surface 106 facing each other in a thickness direction T. Each of the first to fourth surfaces 101, 102, 103, and 104 of the body 100 may correspond to wall surfaces of the body 100 connecting the fifth surface 105 and the sixth surface 106 of the body 100. Hereinafter, both end surfaces of the body 100 may refer to the first surface 101 and the second surface 102 of the body 100, both side surfaces of the body 100 may refer to the third surface 103 and the fourth surface 104 of the body 100, one surface of the body 100 may refer to the sixth surface 106 of the body 100, and the other surface of the body 100 may refer to the fifth surface 105 of the body 100. Further, hereinafter, an upper surface and a lower surface of the body 100 may refer to the fifth surface 105 and the sixth surface 106 of the body 100, respectively, based on the directions of FIGS. 1 to 3.

The body 100 may be formed such that the coil component 1000 according to this embodiment in which the external electrodes 400 and 500 to be described later are formed has a length of 2.0 mm, a width of 1.2 mm, and a thickness of 0.65 mm, but is not limited thereto. Alternatively, the body 100 may be formed such that the coil component 1000 according to this embodiment in which the external electrodes 400 and 500 to be described later are formed has a length of 2.0 mm, a width of 1.6 mm, and a thickness of 0.55 mm. Alternatively, the body 100 may be formed such that the coil component 1000 according to this embodiment in which the external electrodes 400 and 500 to be described later are formed has a length of 2.0 mm, a width of 1.2 mm, and a thickness of 0.55 mm. Alternatively, the body 100 may be formed such that the coil component 1000 according to this embodiment in which the external electrodes 400 and 500 to be described later are formed has a length of 1.0 mm, a width of 0.6 mm, and a thickness of 0.8 mm. Alternatively, the body 100 may be formed such that the coil component 1000 according to this embodiment in which the external electrodes 400 and 500 to be described later are formed has a length of 1.4 mm, a width of 1.2 mm, and a thickness of 0.65 mm. Alternatively, the body 100 may be formed such that the coil component 1000 according to this embodiment in which the external electrodes 400 and 500 to be described later are formed has a length of 1.2 mm, a width of 1.0 mm, and a thickness of 0.55 mm. Since the above-described sizes of the coil component 1000 according to this embodiment are merely illustrative, cases in which sizes are smaller than the above-mentioned sizes may not be excluded from the scope of the present disclosure.

The body 100 may include a magnetic powder particle and an insulating resin. Specifically, the body 100 may be formed by stacking at least one magnetic composite sheet including the insulating resin and the magnetic powder particle dispersed in the insulating resin, and then curing the magnetic composite sheet. The body 100 may have a structure other than the structure in which the magnetic powder particle may be dispersed in the insulating resin. For example, the body 100 may be made of a magnetic material such as ferrite.

The magnetic powder particle may be, for example, a ferrite powder particle or a metal magnetic powder particle.

Examples of the ferrite powder particle may be at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The metal magnetic powder particle may be at least one selected from the group consisting of iron (Fe), silicon (Si), chromium (Cr), cobalt (Co), molybdenum (Mo), aluminum (Al), niobium (Nb), copper (Cu), and nickel (Ni). For example, the metal magnetic powder particle may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The metallic magnetic powder particle may be amorphous or crystalline. For example, the metal magnetic powder particle may be a Fe—Si—B—Cr-based amorphous alloy powder, but is not limited thereto.

The ferrite powder and the metal magnetic powder particle may have an average diameter of about 0.1 μm to 30 μm, respectively, but are not limited thereto.

The body 100 may include two or more types of magnetic powder particles dispersed in an insulating resin. In this case, the term "different types of magnetic powder particle" means that the magnetic powder particles dispersed in the insulating resin are distinguished from each other by diameter, composition, crystallinity, and a shape. For example, the body 100 may include two or more magnetic powder particles of different diameters. The diameter of the metal magnetic powder particle means a diameter according to the particle size distribution of $D_{50}$, $D_{90}$, or the like.

The insulating resin may include an epoxy, a polyimide, a liquid crystal polymer, or the like, in a single form or in combined forms, but is not limited thereto.

The body 100 may include a core 110 passing through the coil portion 300 to be described later. The core 110 may be formed by filling through-holes formed in the insulating substrate 200 with at least a portion of the magnetic composite sheet in operations of stacking and curing the magnetic composite sheet, but is not limited thereto.

One surface of the insulating substrate 200 may be embedded in the body 100 perpendicularly, or substantially perpendicularly, to the fifth and sixth surfaces 105 and 106 of the body 100. The insulating substrate 200 may be configured to support the coil portion 300 to be described later. Coil pattern layers 310 and 320 may be disposed on the one surface and the other surface of the insulating substrate 200 facing each other. The coil portion 300 applied to this embodiment may be disposed perpendicularly, or substantially perpendicularly, to the fifth and sixth faces 105 and 106 of the body 100. The term, "substantially," reflects consideration of recognizable process errors which may occur during manufacturing or measurement.

The insulating substrate 200 may be formed of an insulating material including a thermosetting insulating resin such as an epoxy resin, a thermoplastic insulating resin such as polyimide, or a photosensitive insulating resin, or may be formed of an insulating material in which a reinforcing material such as a glass fiber or an inorganic filler is impregnated with such an insulating resin. For example, the insulating substrate 200 may be formed of an insulating material such as prepreg, Ajinomoto Build-up Film (ABF), FR-4, a bismaleimide triazine (BT) film, a photoimageable dielectric (PID) film, and the like, but are not limited thereto.

As the inorganic filler, at least one or more selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the insulating substrate 200 is formed of an insulating material including a reinforcing material, the insulating substrate 200 may provide better rigidity. When the insulating substrate 200 is formed of an insulating material not containing glass fibers, the insulating substrate 200 may be advantageous for reducing a thickness of the overall coil portion 300. For example, in this embodiment, since the insulating substrate 200 and the coil portion 300 are arranged in a stacked form in the width direction W of the component, a width of the entire component may be minimized. When the insulating substrate 200 is formed of an insulating material containing a photosensitive insulating resin, the number of processes for forming the coil portion 300 may be reduced. Therefore, it may be advantageous in reducing production costs, and a fine via may be formed.

A thickness of the insulating substrate 200 may be less than 30 μm. When the thickness (T1) of the insulating substrate 200 is formed to be 30 μm or more, it may be disadvantageous in reducing the width of the coil component.

The coil portion 300 may be embedded in the body 100 to manifest the characteristics of the coil portion. For example, when the coil component 1000 of this embodiment is used as a power inductor, the coil portion 300 may function to stabilize the power supply of an electronic device by storing an electric field as a magnetic field and maintaining an output voltage.

The coil portion 300 may include the coil pattern layers 310 and 320, and a through-via 330. Specifically, the insulating substrate 200 and the coil portion 300 of this embodiment may be configured such that a first coil pattern layer 310, the insulating substrate 200, and a second coil pattern layer 320 are sequentially arranged in the width direction W from the third surface 103 to the fourth surface 104 of the body 100, as illustrated in FIG. 1. The through-via 330 may pass through the insulating substrate 200 in the width direction W to respectively contact and connect to a first coil pattern 311 of the first coil pattern layer 310 and a second coil pattern 321 of the second coil pattern layer 320. In this configuration, the coil portion 300 may function as a single coil which forms one or more turns about the core 110 overall.

Each of the coil pattern layers 310 and 320 may include the coil patterns 311 and 321 and lead-out patterns 312 and 322. Specifically, the first coil pattern layer 310 disposed on the one surface of the insulating layer 200 facing the third surface 103 of the body 100 may include the first coil pattern 311, and a first lead-out pattern 312 extending from the first coil pattern 311 to be exposed from the sixth surface 106 of the body 100. The second coil pattern layer 320 disposed on the other surface of the insulating layer 200 facing the fourth surface 104 of the body 100 may include the second coil pattern 321, and a second lead-out pattern 322 extending from the second coil pattern 321 to be exposed from the sixth surface 106 of the body 100. The first and second coil patterns 311 and 321 may be a planar spiral shape that forms at least one turn around the core 110, respectively.

The first lead-out pattern 312 applied to this embodiment may be continuously exposed from the first surface 101 and the sixth surface 106 of the body 100, and the second lead-out pattern 322 may be continuously exposed from the second surface 102 and the sixth surface 106 of the body 100. In this case, an area of the lead-out patterns 312 and 322 exposed from the first to sixth surfaces 101, 102, 103, 104, 105, and 106 of the body 100 may increase in the longitudinal direction L and the thickness direction T. Therefore, between the lead-out patterns 312 and 322 and the external electrodes 500 and 600, the contact area and the bonding force may increase, and the contact resistance may be reduced.

At least one of the coil patterns 311 and 321, the lead-out patterns 312 and 322, and the through-via 330 may include at least one conductive layer. For example, when the second coil pattern 321, the second lead-out pattern 322, and the through-via 330 are formed on a side of the other surface of the insulating substrate 200 by a plating process, the second coil pattern 321 and the through-via 330 may include a seed layer and an electroplating layer, respectively. In this case, each of the seed layer and the electroplating layer may have a single-layer structure or a multilayer structure. The electroplating layer of the multilayer structure may be formed using a conformal film structure in which one electroplating layer is covered by another electroplating layer, and another electroplating layer is stacked on only one surface of the one electroplating layer, or the like. The seed layer may be formed by a vapor deposition process such as an electroless plating process, a sputtering process, or the like. In the former case, the seed layer may be formed of an electroless copper plating solution, but is not limited thereto. In the latter case, the seed layer may include at least one of titanium (Ti), chrome (Cr), nickel (Ni), and copper (Cu). The seed layer of the second coil pattern 321 and the seed layer of the through-via 330 may be integrally formed, and no boundary therebetween may occur, but are not limited thereto. The electroplating layer of the second coil pattern 321 and the electroplating layer of the through-via 330 may be integrally formed, and no boundary therebetween may occur, but are not limited thereto.

Each of the coil patterns 311 and 321, the lead-out patterns 312 and 322, and the through-via 330 may be formed of a conductive material such as copper (Cu), aluminum (Al), silver (Ag), tin (Sn), gold (Au), nickel (Ni), lead (Pb), titanium (Ti), or an alloy thereof, but are not limited thereto.

The insulating layers 410 and 420 may be disposed on the one surface and the other surface of the insulating substrate 200 to cover the coil pattern layers 310 and 320, respectively. The first insulating layer 410 may be disposed on the one surface of the insulating substrate 200 to cover the first coil pattern layer 310, and the second insulating layer 420 may be disposed on the other surface of the insulating substrate 200 to cover the second coil pattern layer 320.

The insulating layers 410 and 420 may be for insulating the coil portion 300 from the body 100, and may be formed by stacking insulating films on both surfaces of the insulating substrate 200 on which the coil pattern layers 310 and 320 are formed. The insulating film may be a conventional non-photosensitive insulating film such as Ajinomoto Build-up Film (ABF) or a photosensitive insulating film such as PID.

Each of the coil patterns 311 and 321, the lead-out patterns 312 and 322, and the insulating layers 410 and 420 has one surface contacting the insulating substrate 200, and the other surface facing the one surface. A distance (B) from the one surface to the other surface of the lead-out patterns 312 and 322 (e.g., the thickness (B) of the lead-out patterns 312 and 322) may be longer than a distance (A) from the one surface to the other surface of the coil patterns 311 and 321 (e.g., the thickness (A) of the coil patterns 311 and 321), and may be shorter than a distance (C) from the one surface to the other surface of the insulating layers 410 and 420. For example, the thickness (B) of the lead-out patterns 312 and 322 may be formed to be thicker than the thickness (A) of the coil patterns 311 and 321, based on the cross-section (W-L section) in the width-length direction of FIG. 1. The thickness (B) of the lead-out patterns 312 and 322 may be made thicker than the thickness (A) of the coil patterns 311 and 321, to increase an area of the lead-out patterns 312 and 322 exposed from a surface of the body 100. The height (C) of the insulating layers 410 and 420 from the insulating substrate 200 may be greater than the thickness (B) of the lead-out patterns 312 and 322, to electrically insulate a surface excluding surfaces of the lead-out patterns 312 and 322 exposed from the surface of the body 100 from the body 100.

The external electrodes 500 and 600 may be arranged on the sixth surface of the body 100 to be spaced apart from each other, and may be connected to the lead-out patterns 312 and 322 of the coil portion 300, respectively. The first external electrode 500 may be disposed on the sixth surface 106 of the body 100, to be in contact with and connect to the first lead-out pattern 312 of the first coil pattern layer 310 exposed from the sixth surface 106 of the body 100, and the second external electrode 600 may be disposed on the sixth surface 106 of the body 100, to be in contact with and connect to the second lead-out pattern 322 of the second coil pattern layer 320 exposed from the sixth surface 106 of the body 100.

The external electrodes 500 and 600 applied to this embodiment may be continuously formed on the first and second surfaces 101 and 102, and the sixth surface 106 of the body 100. For example, as described above, since the lead-out patterns 312 and 322 applied to this embodiment are continuously formed on the first and second surfaces 101 and 102, and the sixth surface 106 of the body 100, the external electrode 500 may be continuously formed on the first surface 101 and the sixth surface 106 of the body 100 to cover the lead-out pattern 312, and the second external electrode 600 may be continuously formed on the second surface 102 and the sixth surface 106 of the body 100 to cover the lead-out pattern 322. The external electrodes 500 and 600 may include pad portions 510 and 610 disposed on the sixth surface 106 of the body 100, and extended portions 520 and 620 extending respectively from the pad portions 510 and 610 to the first and second surfaces 101 and 102 of the body 100, respectively.

The external electrodes 500 and 600 may be formed of a conductive material such as copper (Cu), aluminum (Al), silver (Ag), tin (Sn), gold (Au), nickel (Ni), lead (Pb), titanium (Ti), or an alloy thereof, but are not limited thereto.

The external electrodes 500 and 600 may be formed as a single-layer structure or a multilayer structure. As an example, the first external electrode 500 may include a first layer including nickel (Ni), and a second layer disposed on the first layer and including tin (Sn). In this case, the first layer and the second layer may be formed by a plating process, but are not limited thereto. As another example, the first external electrode 500 may include a first layer including copper (Cu), a second layer disposed on the first layer and including nickel (Ni), and a third layer disposed on the second layer and including tin (Sn). In this case, the first to third layers may be formed by a plating process, but are not limited thereto. As another example, the first external electrode 500 may include a resin electrode including a conductive powder particle and a resin, and a plating layer formed on the resin electrode by a plating process. In the first and second examples, the first layer may be formed on the surface of the body 100 to be contact with the lead-out patterns 312 and 322. The first layer, which may be in contact with the lead-out patterns 312 and 322 and may be formed by an electrolytic plating process, may be distinguished by the presence or absence of the resin component and a difference in concentration of the organic substance in the same volume with respect to the resin electrode, may be distinguished by whether or not at least a portion of a material constituting the electrode passes through the body 100 in relation to the electrode formed by a sputtering process, or the like, and may be distinguished by a difference in metal density in the same volume in relation to the electrode formed by an electroless plating process.

Although not illustrated, an external insulating layer may be formed on surfaces of the body 100, except for regions in which the external electrodes 500 and 600 are formed. The external insulating layer may function as a plating resist in forming the external electrodes 500 and 600 on the surface of the body 100 by an electrolytic plating process, but is not limited thereto.

The coil component 1000 according to the present disclosure may be configured such that the sixth surface 106 of the body 100 in which the external electrodes 500 and 600 are disposed together may be mounted on a printed circuit board, or the like, and the largest one surface and the other surface of the insulating substrate 200 are arranged to be perpendicularly, or substantially perpendicular, to the sixth surface 106 of the body 100. As a result, an area occupied by the coil component 1000 on a surface of the printed circuit board to be mounted may be minimized, and, a relatively large number of coil components 1000 may thus be mounted on the printed circuit board having a surface to be mounted with the same area. In addition, the coil pattern layers 310 and 320 may be also arranged perpendicularly, or substantially perpendicularly, to the sixth surface 106 of the body 100, respectively, to minimize noise induced from the printed circuit board due to change in magnetic flux.

Second Embodiment

Figure 4:
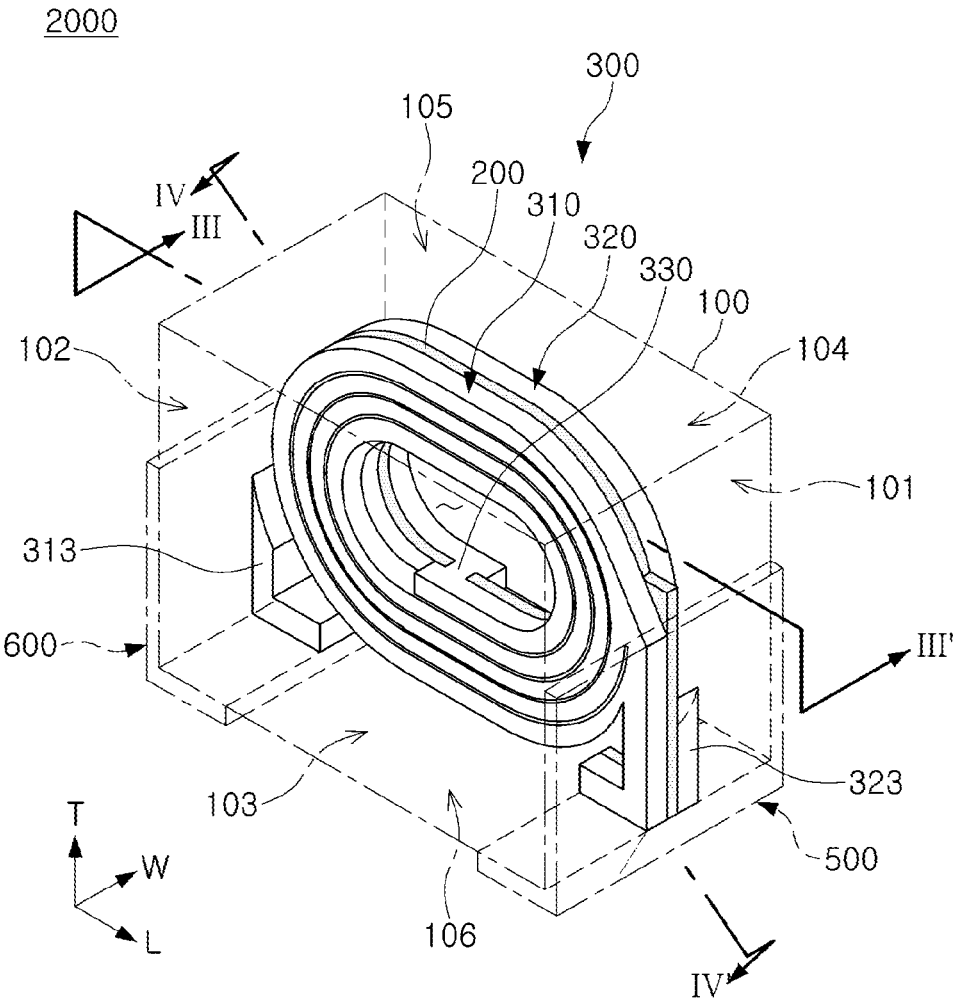
FIG. 4 is a schematic view illustrating a coil component according to a second embodiment of the present disclosure.
Figure 5:
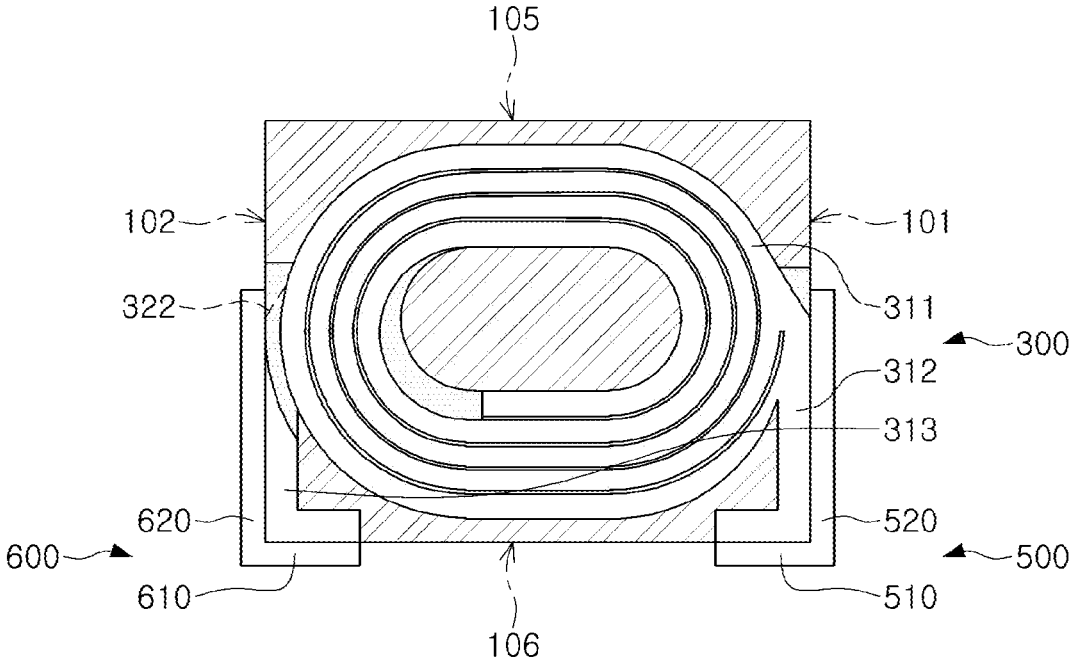
FIG. 5 is a cross-sectional view taken along line of FIG. 4.
Figure 6:
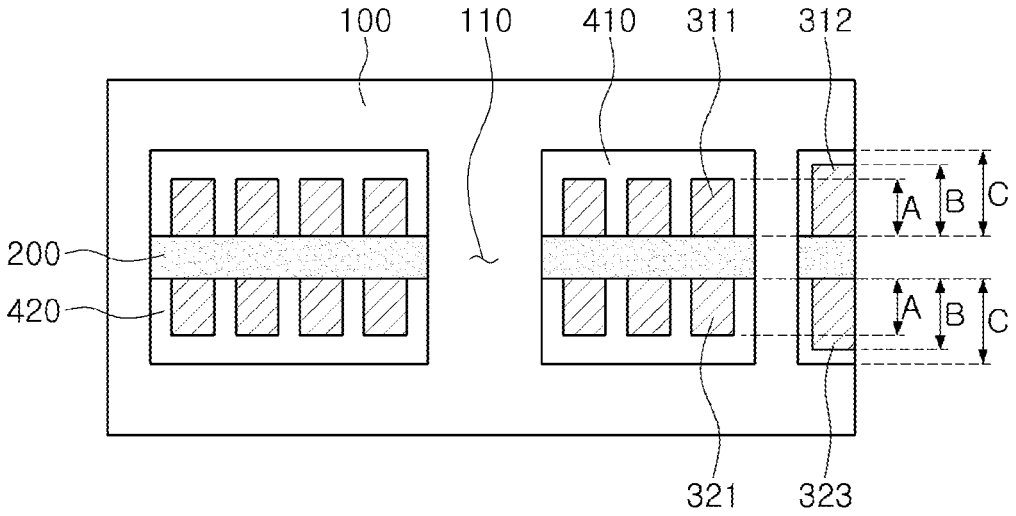
FIG. 6 is a cross-sectional view taken along line IV-IV' of FIG. 4.

FIG. 4 is a schematic view illustrating a coil component according to a second embodiment of the present disclosure. FIG. 5 is a cross-sectional view taken along line of FIG. 4. FIG. 6 is a cross-sectional view taken along line IV-IV' of FIG. 4.

Referring to FIGS. 1 to 6, a coil component 2000 according to this embodiment may differ from the coil component 1000 according to the first embodiment of the present disclosure in view of a coil portion 300. Therefore, in describing this embodiment, only the coil portion 300 different from the first embodiment of the present disclosure will be described. With respect to remaining configurations of this embodiment, the description in the first embodiment of the present disclosure may be applied equally or similarly.

Referring to FIGS. 4 to 6, the coil portion 300 applied to this embodiment further may further include dummy lead-out patterns 313 and 323. In particular, the first coil pattern layer 310 may further include a first dummy lead-out pattern 313 respectively spaced apart from the first coil pattern 311 and the first lead-out pattern 312, and the second coil pattern layer 320 may further include a second dummy lead-out pattern 323 respectively spaced apart from the second coil pattern 321 and the second lead-out pattern 322.

The first dummy lead-out pattern 313 may be continuously exposed from the second surface 102 and the sixth surface 106 of the body 100, and the second dummy lead-out pattern 323 may be exposed from the first surface 101 and the sixth surface 106 of the base body 110. The first dummy lead-out pattern 313 may be connected to the second lead-out pattern 322 by a connection via (not illustrated) passing through the insulating substrate 200, and the second dummy lead-out pattern 323 may be connected to the first lead-out pattern 312 by a connection via (not illustrated) passing through the insulating substrate 200, but are not limited thereto.

The dummy lead-out patterns 313 and 323 have one surface contacting the insulating substrate 200 and the other surface facing the one surface. A distance from the one surface to the other surface of the dummy lead-out patterns 313 and 323 may be substantially identical to a distance (B) from the one surface to the other surface of the lead-out patterns 312 and 322 (e.g., the thickness (B) of the lead-out patterns 312 and 322).

Since the coil portion 300 further includes the dummy lead-out patterns 313 and 323 in this embodiment, the contact area between the coil portion 300 and the external electrodes 500 and 600 may increase to improve the bonding force therebetween.

Third Embodiment

Figure 7:
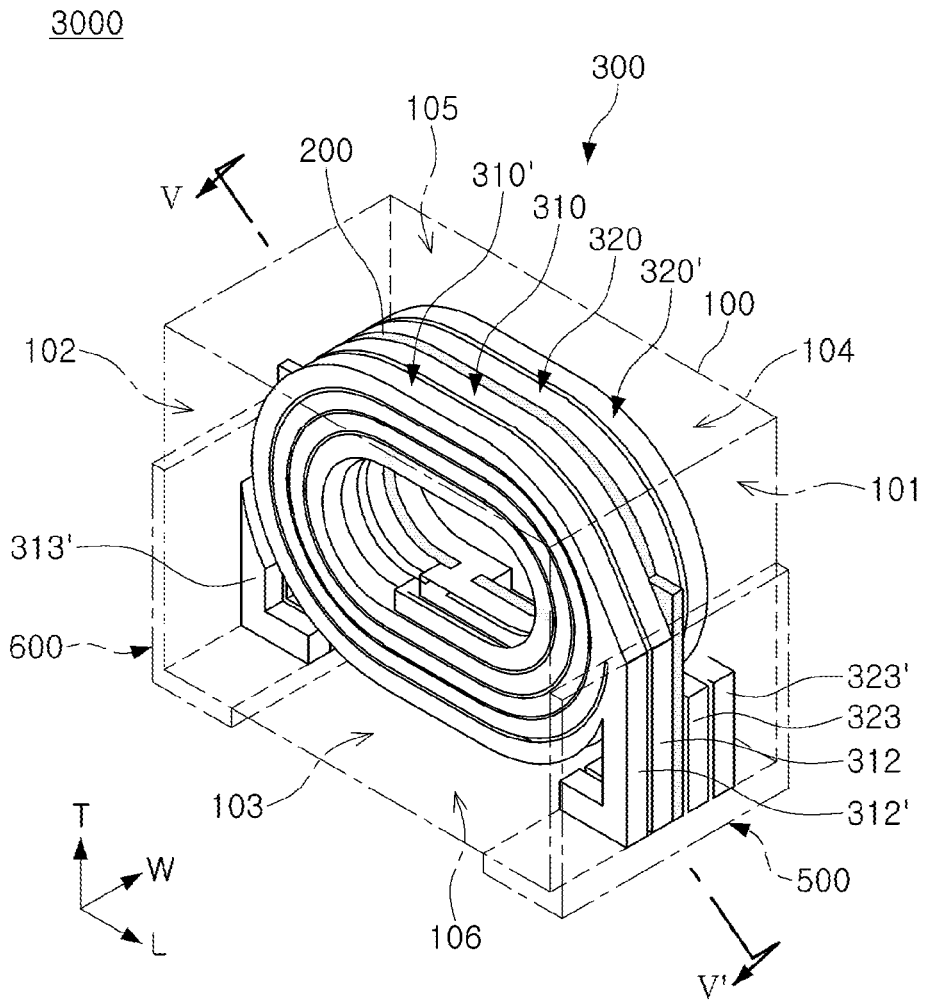
FIG. 7 is a schematic view illustrating a coil component according to a third embodiment of the present disclosure.
Figure 8:
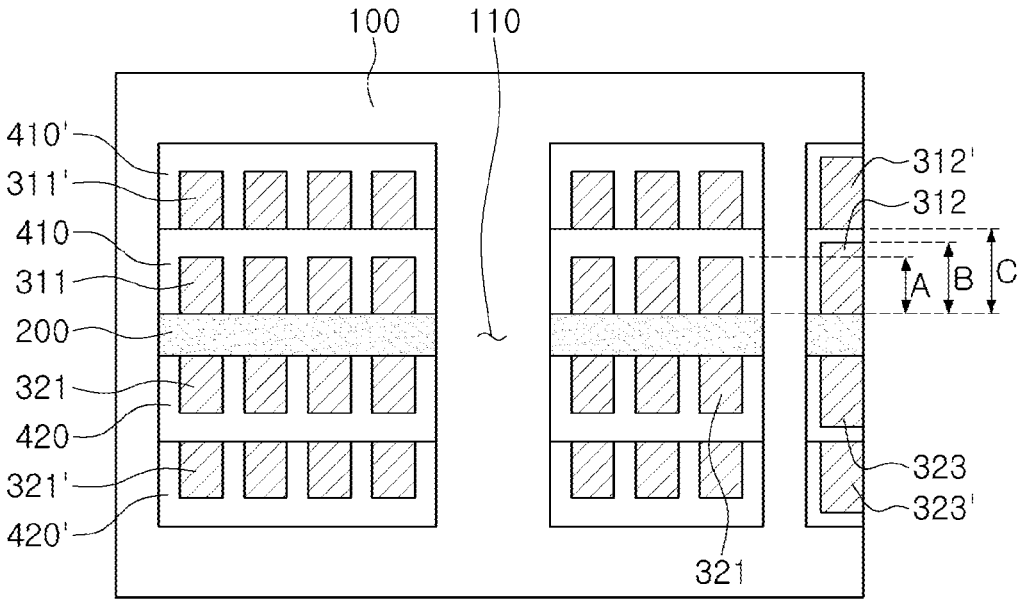
FIG. 8 is a cross-sectional view taken along line V-V' of FIG. 7.

FIG. 7 is a schematic view illustrating a coil component according to a third embodiment of the present disclosure. FIG. 8 is a cross-sectional view taken along line V-V' of FIG. 7.

Referring to FIGS. 1 to 8, a coil component 3000 according to this embodiment may be different from the coil components 1000 and 2000 according to the first and second embodiments of the present disclosure, in view of a coil portion 300, and insulating layers 410, 410', 420, and 420'. Therefore, in describing this embodiment, only the coil portion 300 and the insulating layers 410, 410', 420, and 420', different from the first and second embodiments of the present disclosure, will be described. With respect to remaining configurations of this embodiment, the description of the first embodiment and/or the second embodiment of the present disclosure may be applied equally or similarly.

Referring to FIGS. 7 and 8, first and second coil pattern layers 310, 310', 320, and 320' of the coil portion 300 may be formed in plural. The coil pattern layer 310' may include a coil pattern 311', a lead-out pattern 312' extending from the coil pattern 311', and a dummy lead-out pattern 313' spaced apart from the coil pattern 311'. The coil pattern layers 320' may include a coil patterns 321', a lead-out pattern (not labeled) extending from the coil pattern 321', and a dummy lead-out pattern 323' spaced apart from the coil pattern 321'. Structures of the lead-out patterns and the dummy lead-out patterns of the coil pattern layers 310' and 320' may be the same as, or similar to, those of the lead-out patterns or the dummy lead-out patterns of the coil pattern layers 310 and 320, except that the lead-out patterns and the dummy lead-out patterns of the coil pattern layers 310' and 320' are disposed on different levels in the width direction W. For example, first coil pattern layers 310 and 310' disposed on the one surface of the insulating substrate 200 may be formed of two or more layers, and second coil pattern layers 320 and 320' disposed on the other surface of the insulating substrate 200 may be formed of two or more layers. First insulating layers 410 and 410', and second insulating layers 420 and 420' may be formed in plural, such that the first insulating layers 410 and 410' are between neighboring first coil pattern layers 310 and 310' and on an outermost first coil pattern layer among the first coil pattern layers 310', and the second insulating layers 420 and 420' are disposed between neighboring second coil pattern layers 320 and 320' and on an outermost second coil pattern layer among the second coil pattern layers 320'. For example, the insulating layer 410, 410', 420, and 420' formed of a plurality of layers may cover the coil portion 300 together with the insulating substrate 200.

In this embodiment, since the first and second coil pattern layers are formed in plural, each of the coil pattern layers is formed to have a shorter distance, from one surface to the other surface, than the coil pattern layer in the above-described embodiments. For example, a thickness (A) of the first coil pattern in this embodiment may be thinner than the thickness (A) of the first coil pattern in the above-described embodiments. Therefore, in this embodiment, the coil pattern layer may have a relatively low aspect ratio (AR), to form a coil having a flat shape as a whole. In this embodiment, since the aspect ratio of the coil pattern layer is relatively low, it is possible to reduce the defect rate in formation of the coil pattern layer, and to minimize the cost thereof. Further, a width of the component may be reduced.

In a case that an cross-sectional area in the thickness-length direction (T-L cross-section) of the body 100 may be the same, and cross-sectional areas of each turn of the coil pattern layer are the same, when the aspect ratio of the coil pattern layer is low, the number of turns of the coil pattern layer may decrease, and the characteristics of the component may thus be deteriorated. In this embodiment, a plurality of coil pattern layers may be formed and connected to each other.

As described above, the thickness (B) of the lead-out patterns 312 and 322 and the dummy lead-out patterns may be formed to be thicker than the thickness (A) of the coil patterns 311 and 321. Therefore, in this embodiment, the distance between the neighboring lead-out patterns, the distance between the neighboring dummy lead-out patterns, and/or the distance between the neighboring lead-out patterns and dummy lead-out patterns may be formed to be shorter than the distance between the neighboring coil patterns. As a result, the external electrode may be formed more easily by a plating process, and the bonding force between the external electrode and the lead-out pattern may be improved.

According to the present disclosure, in the coil component, the reliability of bonding between the lead-out pattern of the coil pattern layer and the external electrode may be improved, while low profile may be achieved.

While example embodiments have been illustrated and described above, it will be apparent to those skilled in the art that modifications and variations could be made without departing from the scope of the present disclosure as defined by the appended claims.

What is claimed is:

1. A coil component comprising:

a body having one surface, and one end surface and the other end surface, respectively connected to the one surface and facing each other;

a coil portion disposed in the body, and including a plurality of coil pattern layers spaced apart from each other in one direction, respectively substantially parallel to the one surface, the one end surface, and the other end surface of the body; and an insulating layer disposed between the plurality of coil pattern layers, wherein the plurality of coil pattern layers comprise first and second coil pattern layers, the first coil pattern layer comprises a first coil pattern disposed substantially perpendicular to the one surface of the body, a first lead-out pattern connected to the first coil pattern and being in contact with the one end surface of the body and the one surface of the body, and a first dummy lead-out pattern spaced apart from the first coil pattern and being in contact with the other end surface of the body and the one surface of the body, the second coil pattern layer comprises a second coil pattern disposed substantially perpendicular to the one surface of the body, a second lead-out pattern connected to the second coil pattern and being in contact with the other end surface of the body and the one surface of the body, and a second dummy lead-out pattern spaced apart from the second coil pattern and being in contact with the one end surface of the body and the one surface of the body, the first lead-out pattern and the second dummy lead-out pattern are connected to each other by a connection via passing through the insulating layer, and a thickness (B) of the first lead-out pattern in the one direction is thicker than a thickness (A) of the first coil pattern in the one direction.

2. The coil component according to claim 1, wherein a distance between the first and second coil patterns in the one direction is greater than a distance between the first and second lead-out patterns in the one direction.

3. The coil component according to claim 1, wherein a thickness of the first dummy lead-out patterns in the one direction is greater than the thickness (A) of the first coil pattern in the one direction.

4. The coil component according to claim 1, wherein the insulating layer comprises an insulating substrate, and first and second insulating layers respectively disposed on one surface and the other surface of the insulating substrate, facing each other, the first coil pattern layer is disposed on the one surface of the insulating substrate, and the second coil pattern layer is disposed on the other surface of the insulating substrate, the first insulating layer is disposed on the one surface of the insulating substrate to cover the first coil pattern layer, and the second insulating layer is disposed on the other surface of the insulating substrate to cover the second coil pattern layer.

5. The coil component according to claim 4, wherein the coil portion further comprises a through-via passing through the insulating substrate to connect the first coil pattern layer and the second coil pattern layer.

6. The coil component according to claim 1, further comprising first and second external electrodes disposed on the one surface of the body to be spaced apart from each other and connected to the first and second lead-out patterns, respectively.

7. The coil component according to claim 6, wherein the first external electrode has a first pad portion disposed on the one surface of the body, and a first extended portion extending from the first pad portion to the one end surface of the body, and the second external electrode has a second pad portion disposed on the one surface of the body, and a second extended portion extending from the second pad portion to the other end surface of the body.

8. The coil component according to claim 6, wherein each of the first and second external electrodes comprises a plating layer contacting the first and second lead-out patterns.

9. The coil component according to claim 1, wherein the body comprises an insulating resin and a magnetic powder particle.

10. The coil component according to claim 1, wherein each of the plurality of coil pattern layers comprises a coil pattern disposed substantially perpendicular to the one surface of the body, and a lead-out pattern exposed from the one surface of the body and one of the one end surface and the other end surface of the body.

11. A coil component comprising:

a body having one surface, and one end surface and the other end surface, respectively connected to the one surface and facing each other;

first to third insulating layers; and first to fourth coil pattern layers spaced apart from each other in one direction, wherein the first insulating layer is disposed between the third and first coil pattern layers, the second insulating layer is disposed between the second and fourth coil pattern layers, the third insulating layer is disposed between the first and second coil pattern layers, the first coil pattern layer is disposed between the first and third insulating layers, and the second coil pattern layer is disposed between the second and third insulating layers, wherein each of the first to fourth coil pattern layers comprises a coil pattern disposed, and a lead-out pattern exposed from the one surface of the body and one of the one end surface and the other end surface of the body, and a distance in the one direction between the lead-out pattern of the third coil pattern layer and the lead-out pattern of the first coil pattern layer is less than a distance in the one direction between the coil pattern of the third coil pattern layer and the coil pattern of the first coil pattern layer.

12. The coil component according to claim 11, wherein a thickness (B) of the lead-out patterns in the one direction is thicker than a thickness (A) of the coil patterns in the one direction.

13. The coil component according to claim 11, wherein each of the first to fourth coil pattern layers further comprises a dummy lead-out pattern respectively spaced apart from the coil pattern and the lead-out pattern, and being in contact with an end surface which the lead-out pattern is spaced apart from, among the one end surface and the other end surface of the body, and the one surface of the body, wherein a thickness of the dummy lead-out patterns in the one direction is greater than a thickness (A) of the coil patterns in the one direction.

14. The coil component according to claim 11, wherein the coil portion further comprises a through-via passing through the third insulating layer to connect the first coil pattern layer and the second coil pattern layer.

15. The coil component according to claim 11, wherein the body comprises an insulating resin and a magnetic powder particle.

16. The coil component according to claim 11, further comprising first and second external electrodes disposed on the one surface of the body to be spaced apart from each other and connected to one or more of the lead-out patterns, respectively.

17. The coil component according to claim 16, wherein the first external electrode has a first pad portion disposed on the one surface of the body, and a first extended portion extending from the first pad portion to the one end surface of the body, and the second external electrode has a second pad portion disposed on the one surface of the body, and a second extended portion extending from the second pad portion to the other end surface of the body.

18. The coil component according to claim 16, wherein each of the first and second external electrodes comprises a plating layer contacting the first and second lead-out patterns.

* * * * *